US009382606B2

(12) United States Patent
Zak

(10) Patent No.: US 9,382,606 B2
(45) **Date of Patent: *Jul. 5, 2016**

(54) COMPOSITE ARTICLE AND METHOD

(75) Inventor: Gad Zak, Pointe-Claire (CA)

(73) Assignee: MARIA DA COSTA DESIGN INC, Montreal (CA)

( * ) Notice: Subject to any disclaimer, the term of this patent is extended or adjusted under 35 U.S.C. 154(b) by 452 days.

This patent is subject to a terminal disclaimer.

(21) Appl. No.: 13/442,114

(22) Filed: Apr. 9, 2012

(65) Prior Publication Data

US 2012/0216921 A1 Aug. 30, 2012

Related U.S. Application Data

(63) Continuation of application No. 12/272,675, filed on Nov. 17, 2008, now Pat. No. 8,262,814.

(51) Int. Cl.

| | |
|---|---|
| ***C22C 14/00*** | (2006.01) |
| ***C22C 16/00*** | (2006.01) |
| ***C23C 8/02*** | (2006.01) |

(Continued)

(52) U.S. Cl.

CPC ..... *C23C 8/02* (2013.01); *B22D 25/026* (2013.01); *C22C 14/00* (2013.01); *C22C 16/00* (2013.01); *C23C 8/10* (2013.01); *C23C 8/80* (2013.01);

(Continued)

(58) Field of Classification Search

CPC ..... C22C 14/00; C22C 16/00

USPC ..... 148/281, 421, 669–672; 420/417, 422

See application file for complete search history.

(56) References Cited

U.S. PATENT DOCUMENTS

| | | | |
|---|---|---|---|
| 5,820,707 A | 10/1998 | Amick et al. | |
| 5,868,879 A | 2/1999 | Amick et al. | |

FOREIGN PATENT DOCUMENTS

| | | | | |
|---|---|---|---|---|
| CA | 2130244 | | 2/1995 | |
| GB | 1305879 | * | 2/1973 | ..... A61C 13/00 |

OTHER PUBLICATIONS

Equo Kobayashi, Shigeru Matsumoto, Hisashi Doi, Takayuki Yoneyama, and Hitoshi Hamanaka; "Mechanical Properties of the binary titanium—zirconium alloys and their potential for biomedical materials"; Journal of Biomedical Material Research, vol. 29, 943-950 (1995).

(Continued)

*Primary Examiner* — Brian Walck

(74) *Attorney, Agent, or Firm* — Defillo & Associates, Inc.; Evelyn A. Defillo

(57) ABSTRACT

A method and a product made through it by utilizing Zirconium alloys containing Titanium in the manufacture of metal articles of sports, night stealth compatible articles for law enforcement and military equipment, night-stealth personal and body adornments for members of such forces, garden and household implements, fashion accessories, body art articles, and medical and dental implants, and other articles. The articles benefit from any combination of properties from being hypo-allergenic, possessing high tensile strength, abrasion resistance, and hardness, having low ductility and elasticity and of having the outer appearance within the scale of dark grey to blackness. In this method an alloy of components in their respective ratios from within the method's stipulated preferred range is shaped into a work piece by conventional metal forming devices and methods, and then subjected to an oxidation process and optional quenching steps. The oxidation is achieved through heating the work piece that is made out in the alloy in oxygen containing atmospheric ambience in one or two cycles.

4 Claims, 1 Drawing Sheet

(51) Int. Cl.

| | |
|---|---|
| ***B22D 25/02*** | (2006.01) |
| ***C23C 8/10*** | (2006.01) |
| ***C23C 8/80*** | (2006.01) |

(52) U.S. Cl.
CPC ..... *Y10T 428/13* (2015.01); *Y10T 428/31678* (2015.04)

(56) References Cited

OTHER PUBLICATIONS

Ikarashi, Yoshiaki et al,Materials Transactions, vol. 46, No. 10, pp. 2260-2267, 2005.

* cited by examiner

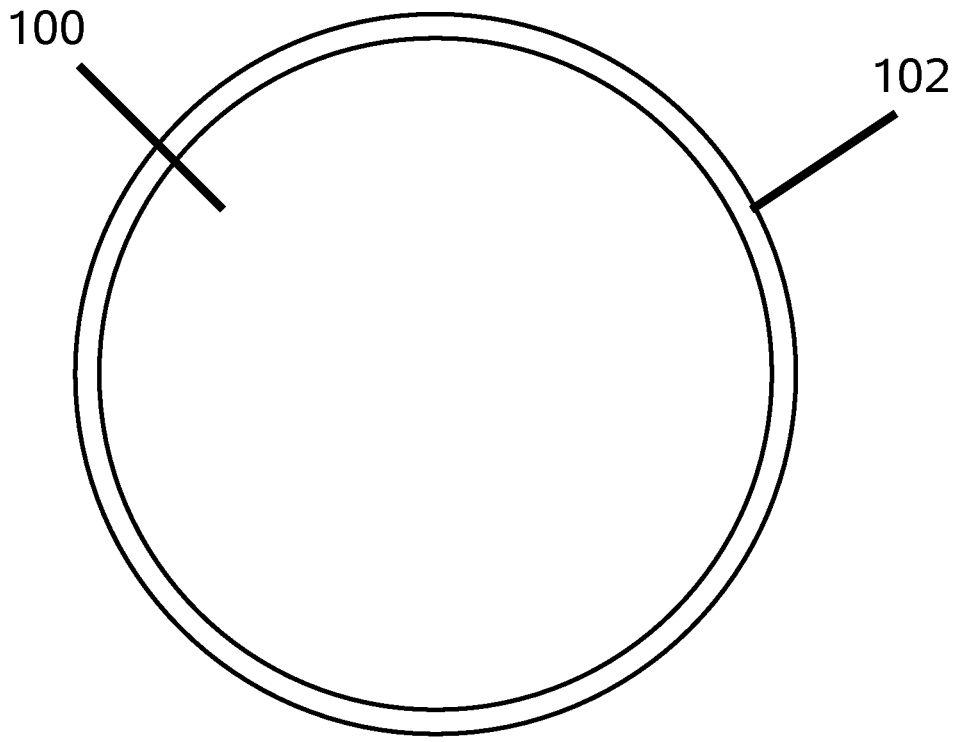
100
102

COMPOSITE ARTICLE AND METHOD

REFERENCE TO RELATED APPLICATIONS

This is a continuation application of U.S. patent application Ser. No. 12/272,675 filed on Nov. 17, 2008, now U.S. Pat. No. 8,262,814.

FIELD

The present invention relates to methods for forming a protective dark oxide layer or coating upon an article comprising zirconium, and to articles formed thereby. More specifically, the invention relates to the formation of a protective dark oxide layer upon an article consisting of certain binary zirconium titanium alloys, and to the articles formed thereby.

BACKGROUND

With the increase in civil use of what was considered during the "cold war" years "strategic" or "restricted" metals, such as zirconium and titanium, and the accompanying drop in their prices, an increasing number of consumer goods, medical, dental and orthopedic, civil engineering and architectural structural and decorative components, and other industrial as well as civil and military uses have been made of metals such as zirconium, titanium, and alloys thereof. With this increase in use, there has been a growing interest in their unique metallurgical properties and advantages as employed in known and new applications. These properties include very high tensile and yield strength, light weight, and chemical inertness together with its corollary hypoallergenic property, which makes these metals and alloys suitable for dental, orthopedic and other prostheses such as joint replacements, arterial stents, and cardiac valves, as well as for consumer fashion accessories that benefit from the same properties, such as body-piercings, wrist watches, sunglass frames, and the like.

Increased interest in these metals and their uses has been accompanied by demand for methods for providing hardened surfaces, for providing surfaces exhibiting reduced friction, and for improving surface appearance.

Anodizing is known for altering the color and surface appearance of titanium and niobium. Anodizing of these metals and certain of their alloys generates a thin, colorful outer layer on the metal, which wears off readily and is easily scratched, chipped, or otherwise removed.

U.S. Pat. No. 6,093,259 to Watanabe et al. teaches methods for providing various colored surfaces on titanium by treatment with aqueous alkaline solutions of KOH, NaOH and LiOH, applied singly or as a mixture, optionally accompanied by thermal treatment at moderate temperatures, and optionally comprising a nitriding process.

U.S. Pat. No. 5,037,438 to Davidson, and U.S. Pat. No. 5,169,597 to Davidson et al., disclose surface treatment of another cold war metal, zirconium, by thermal or salt bath oxidation within temperature ranges readily achievable by conventional kilns, for improving mechanical and metallurgical properties. The resulting smooth and very hard blackened surface reportedly reduced friction, increased scratch resistance, enhanced the strength of the metal immediately beneath the surface coating, and provided a blue/black colored surface. These enhancements were attributed to oxygen diffusion into the substrate metal, which also improved the fatigue properties of the metal.

In attempting to produce articles that require or would benefit from the combination of high tensile strength, hardness, scratch and wear resistance, and color control from dark grey to black, light weight, and hypoallergenicity, it is know that zirconium and titanium provide these benefits to varying degrees.

However, unalloyed titanium colored according to the method taught by Watanabe et al. does not exhibit enhanced resistance to wear and generally retains the properties of untreated titanium. Also, the method requires the use of hazardous materials, personal safety equipment such as gas masks, impermeable gloves, complete skin coverage, and the like.

Using unalloyed zirconium to the extent taught by Davidson, is limited to unalloyed zirconium or alloys containing at least 80% zirconium, and preferably from about 95% to about 100%, by weight. In contrast, Davidson et al. teach the use of a ternary alloy including niobium, adding cost and complexity compared to binary alloys. Davidson and Davidson et al. are primarily directed to weight bearing prosthetic implants, for which color control is relatively unimportant.

While unalloyed zirconium displays high tensile strength, hypoallergenicity, and a beneficial surface coating when oxidized, it is known that alloys containing both zirconium and titanium offer superior metallurgical properties compared to each metal alone. Yoshiaki, I. et al. "Improved Biocompatibility of Titanium-Zirconium (Ti—Zr) Alloy: Tissue Reaction and Sensitization to Ti—Zr Alloy Compared with Pure Ti and Zr in Rat Implantation" Mater. Trans. 46(10): 2260-2267 (2005) (teaching superior biocompatibility of Ti—Zr alloys compared to each metal alone).

Certain ratio ranges of zirconium to titanium exhibit superior mechanical properties compared to the component metals in the unalloyed state. Kobayashi, E. "Mechanical properties of the binary titanium-zirconium alloys and their properties for biomedical purposes" J. Biomed Materials Research 29(8) (1995). Alloys in the range of 1:1 zirconium: titanium by weight, disclosed for use as dental implants, exhibit hardness and tensile strength about 2.5 times as high as the unalloyed components. These results were reported for both cast and homogenized specimens.

Ternary alloys containing zirconium, titanium and a third metal are also known for applications including prostheses. U.S. Pat. No. 5,820,707 and to Amick et al. teach ternary alloys including a third metal selected from niobium, tantalum and vanadium. The third metal is taught as passivating the tendency of the zirconium and titanium to ignite and combust. Amick et al. teaches very high temperatures and long duration for complete or near complete oxidation of the alloy workpiece, which therefore requires passivation through the inclusion of the third metal in the alloy. The method reportedly provides smooth and hard surfaces, which for some alloys are described as being "blue/black".

U.S. Pat. No. 6,759,134 to Rosenberg discloses ternary alloys containing titanium, niobium, and a third metal from the group consisting of zirconium, tantalum, molybdenum, hafnium, zirconium, chromium, with emphasis on alloys containing from 3% to 17% by weight niobium for its passivating properties and for the creation of a smooth and hard surface layer of niobium containing oxide with an aesthetic chromatic value.

However, Amick et al. and Rosenberg require at least a ternary alloy, do not teach control of the surface shade on a scale from dark gray to black, and do not teach the benefits of enhanced tensile strength of the treated alloy.

In sum, Yoshiaki et al. and Kobayashi et al. teach binary zirconium titanium alloys of specified weight ratio that possess good metallurgical, mechanical and hypoallergenic properties. The ternary alloys of Amick et al. and Rosenberg are more intricate and costly to produce and have not been shown to possess the additional strength and hypoallergenic benefits of the binary alloy. Davidson and Davidson et al. teach the benefits of zirconium based alloys comprising a zirconium oxide coating, while Rosenberg and Amick et al. offer combinations that rely upon the presence of niobium oxide in the coating, which form of the oxide was not shown to possess the same enhanced strength and fatigue resistance as the primarily zirconium oxide coating disclosed by Davidson.

While the prior art provides a subset of the group of properties required by and benefiting various articles, namely, high tensile strength, high hardness, low ductility and elasticity, enhanced fatigue resistance, and biocompatability, controllable shades of dark gray to black, it does not teach the capability to combine the full scope of all of these benefits, nor does it offer the benefits of simplicity and cost reduction to be gained through the use of a binary alloy.

Therefore, there is a need in the art for alloys and surface coatings capable of providing articles exhibiting all of the potential beneficial properties available from zirconium titanium binary alloys. All this and more will become apparent to one of ordinary skill upon reading the following disclosure and claims.

SUMMARY

The present invention is directed in one aspect to a method for overcoming the aforementioned disadvantages and limitations of the prior art by providing a method for darkening and hardening the surface of an article consisting of a binary zirconium titanium alloy of specified composition. The inventor has found a synergistic combination, within articles produced by the method, of the metallurgical, mechanical, and hypoallergenic advantages of certain binary zirconium titanium alloys, combined with a hardened, darkened surface that resists abrasion, and has a color from gray to blackness that is selectable according to the parameters of the method.

In a first aspect, a method having features of the present invention includes the a step of providing an article consisting of between about 30.9% and about 65.6% zirconium by atomic weight and titanium. Without limitation, the articles can be formed into their desired shapes by machining, casting, die forging, stamping, or the like. The articles optionally comprise a polished, satin, or matte finish, which influences the texture of the finished blackened surface. The method further comprises heating the article in an oxygen containing atmosphere at a temperature of between about 250 and about 880 degrees Celsius for between about 10 and about 110 minutes to produce the hardened, darkened surface. In certain preferred aspects the alloy consists of between about 34.4% and about 65.6% zirconium by atomic weight.

In a second aspect, a method having features of the present invention includes the a step of providing an article consisting of between about 30.9% and about 65.6% zirconium by atomic weight and titanium. The method further comprises heating the article in an oxygen containing atmosphere in a first heating step and a second heating step with a quenching step interposed, the heating steps being performed at a temperature of between about 250 and about 880 degrees Celsius for a total duration of between about 10 and about 110 minutes to produce the hardened, darkened surface. Optionally, the first heating step is performed at a lower temperature than said second heating step. For example, and without limitation, in certain embodiments, the first heating step is carried out at a temperature of between about 250 and about 480 degrees Celsius for between about 10 and about 40 minutes, and the second heating step is carried out at a temperature of between about 480 and about 880 degrees Celsius for between about 10 and about 70 minutes.

In certain embodiments, the oxygen containing atmosphere is air.

In another aspect, an article having features according to the present invention comprises zirconium titanium binary alloy article consisting of between about 30.9% and about 65.6% zirconium by atomic weight and titanium further comprising a darkened oxide containing surface or portion thereof produced according to one of the foregoing methods.

In certain preferred aspects the article consists of between about 34.4% and about 65.6% zirconium by atomic weight.

It is therefore an object of the present invention to provide articles that require or benefit from any combination of properties from within the group comprising, without limitation, high tensile strength, high hardness, resistance to fatigue or wear or scratch, low ductility and elasticity, hypoallergenicity, and shades of gray and blackness.

It is a further object of the invention to provide articles comprising an aesthetic outer surface or coating that exhibits shades from gray to blackness.

It is a further object of the invention to provide articles comprising a darkened surface suitable for stealth goods, hunting and sporting equipment.

It is a further object of the invention to provide a ceramic-like coating that exhibits low wear and low friction suitable for articles requiring extended periods of mechanical contact, such as for example butterfly valves.

It is a further object of the invention to provide a matte or satin coating that has low reflectivity and is suitable for stealth or nighttime articles.

These and other features, aspects, and advantages of the present invention will become better understood with reference to the following description and appended claims.

BRIEF DESCRIPTION OF THE DRAWINGS

FIG. 1 illustrates a sectional view of an article including a binary alloy according to an exemplary embodiment of the present invention.

DESCRIPTION

The composition of binary zirconium titanium alloys 102 in the present disclosure are expressed by atomic weight ratio. To convert from atomic weight ratio to actual weight ratio, the product of a selected element's atomic weight and its atomic weight ratio in percentage is divided by the sum of such products for the alloy constituents. For example, a ratio of 34.42% zirconium to 65.58% titanium by atomic weight, given an atomic weight for Ti of 47.867 and an atomic weight for Zr as 91.224, provides the following for the titanium ratio by weight:

$$(47.867\times65.58\%):(47.867\times65.58\%+91.224\times34.42\%)\times100=49.99\%$$

the balance zirconium, or art-recognized levels of impurities.

The binary zirconium titanium alloys 102 for use in the methods and articles 100 according to the present invention consist of between about 30.9% and about 65.6% zirconium by atomic weight and titanium. Trace amounts of impurities, including other metals, may be present to an art-recognized degree. Certain alloys for use in the present invention can be purchased from any of several metal alloy-producing mills producing zirconium titanium alloys worldwide, and in particular in North America, and in Central and Eastern Europe.

In preferred embodiments, a binary alloy 102 consisting of from about 65.58% titanium by atomic weight (about 50% by weight) and about 34.42% zirconium by atomic weight (about 50% by weight) is used, or alloys are used that fall within about 4% of these values. Kobayashi et al. (supra) report superior strength and hardness, up to 2.5 fold, of these alloys compared to pure zirconium and titanium.

The articles 100 of the present invention can be made by any means known in the art for shaping zirconium titanium alloys, including without limitation machining, casting, stamping, or die-forging. It is known that certain compositions of zirconium titanium alloys are ignitable (see, e.g. U.S. Pat. No. 5,820,707 to Amick et al.) and highly reactive so due care must be taken when working such alloys. Machining requires precautionary measure as are known in the art, including but not limited to slow speeds and liberal lubrication and cooling. Likewise, opening of a casting investment must be performed only after complete cooling.

The article 100 is heated, preferably by heating in a kiln providing an oxygen containing ambient gas, to within the range of about 250 degrees Celsius to about 880 degrees Celsius. In certain embodiments, a single heating step is provided comprising a duration of from about 10 to about 110 minutes, followed by air cooling, water quenching, or the like.

The inventor has found that with an increased gas supply, oxidation proceeds more rapidly but is accompanied by an increased risk of combustion. In preferred embodiments, a kiln is selected to have a moderate and unforced air supply in the range of 4 to 6 square inches per cubic foot of kiln volume.

Preferably, two heating steps are used, with a quenching step such as a water or air quenching interposed between the heating steps. The temperature and duration of heating are selected to provide a strongly adherent oxide-rich layer with the desired shade from gray to blackness and sufficient wear resistance. Outer layers or coatings having a darker appearance exhibit excellent resistance to wear and penetrate somewhat deeper into the substrate alloy. Where the surface of the article 100 to be treated is polished, a smooth coating is obtained that is sufficiently hard and wear resistant to be particularly suited for uses involving frequent sliding contact with other surfaces, or impacts, or the like. Articles 100 to be treated that have a brushed surface texture provide lighter shades.

Most preferably, a first heating step at a lower temperature is followed by a second heating step, with a quenching step interposed between the two. This process has been found beneficial to reduce ignition risk. In preferred embodiments, a first heating step can comprise heating to between about 250 degrees Celsius to about 480 degrees Celsius for between about 10 to about 40 minutes. Following an optional quenching step, a second heating step can be performed by heating to between about 480 degrees Celsius to about 880 degrees Celsius for up to about 100 minutes or until a predetermined gray tone or degree of blackness is obtained.

Not to be thereby limited by theory, the thermal treatment of the present invention provides an oxide layer that is believed to comprise a high proportion of zirconium oxide and to further harden and strengthen the metal by the diffusion of oxygen within the partially oxidized surface layer, and in the deeper alloy substrate to which it is adherent. In embodiments comprising two heating steps, it is believed that a thicker final oxide layer is formed due to the possibility that oxygen penetrates more deeply into the substrate metal during a first, lower temperature, step than it does if exposed to an initial higher temperature that produces a more rapid thickening of the oxide layer.

Articles 100 treated according to the method of the present invention are less susceptible to subsequent ignition. Exposure of treated samples to direct flame in the range of 1,300 to 1,400 degrees Celsius for up to ten minutes failed to combust or undergo further oxidation. This property usefully extends the range of applications of the present invention to include, for example, firearm parts, subject to proper testing and certification.

EXAMPLES

Alloys for use in the method and article of the present invention are exemplified in TABLE 1:

| ALLOY | % Zr by atomic wt. | % Ti by atomic wt. |
|---|---|---|
| I | 34.42 | 65.58 |
| II | 33.52 | 66.48 |
| III | 30.89 | 69.11 |
| IV | 40.05 | 59.95 |
| V | 67.37 | 32.63 |

In TABLE 2, it is demonstrated that the duration and temperature of thermal treatment can be adjusted to control the resulting shade of gray or blackness in the resulting article. A darker surface is obtained with longer and/or hotter treatment, while a lighter gray finish is obtained at lower temperatures and/or shorter duration.

Results obtained with the present invention are compared in TABLE 2 with unalloyed zirconium (Zr702) and a zirconium alloy with low levels (2-3%) of niobium (Zr705).

TABLE 2

Formation of a darkened, hardened coating according to the method of the present invention.

| | Alloy | 1st cycle (min) | 1st cycle (C.) | 2nd cycle (min) | 2nd cycle (C.) | Resulting surface* |
|---|---|---|---|---|---|---|
| 1 | II | 25 | 250 | 50 | 750 | Dark blackness, smooth* |
| 2 | VI | 35 | 250 | 35 | 680 | Medium blackness, smooth* |
| 3 | II | 30 | 350 | 30 | 725 | Pitch black, smooth* |
| 4 | VI | 40 | 650 | — | — | Light blackness, smooth* |
| 5 | II | 65 | 600 | — | — | Medium blackness, matte |
| 6 | VI | 30 | 250 | 80 | 480 | Medium gray, smooth* |
| 7 | II | 25 | 650 | — | — | Medium charcoal gray, smooth* |
| 8 | VI | 13 | 880 | — | — | Light to medium charcoal gray, smooth* |
| 9 | II | 11 | 880 | — | — | Light to medium gray, smooth* |
| 10 | Zr702 | 35 | 620 | — | — | Medium charcoal, matte |
| 11 | Zr702 | 70 | 700 | — | — | Pitch black, smooth* |
| 12 | Zr705 | 40 | 650 | — | — | Light charcoal, matte |
| 13 | Zr702 | 25 | 300 | 26 | 600 | Medium to dark charcoal, matte |

*articles polished prior to treatment

In a further example, a night-stealth automotive hubcap is provided. The hubcap is cast into the desired shape and provided with a satin-like low-polish. The hubcap is then heated to within the range of 250 to 350 degrees for from 10 to 40 minutes. Next, the hubcap is heated by the same method for 20 to 40 minutes at 600 to 700 degrees Celsius. The hubcap is from charcoal gray to blackness in appearance and has a matte, wear resistant surface.

In use, the method of the present invention is used to produce articles that are also encompassed by the present invention. The articles can be any article consisting of zirconium titanium alloy within the composition range of the present invention that requires or may benefit from a hard, tough, gray to black outer surface layer. Without limitation, articles within the scope of the present invention can include articles that comprise pivoting or swiveling parts such as revolving disk and butterfly valves, cardiac valves, and valves for liquids and gases. In these applications, the swiveling parts can be springingly retained about their axis by insertion under tensile stress between mounting points, or more loosely retained. Other article embodiments can include dental implants and medical prostheses such as joint and bone replacements. Further, the present invention can provide a tough and attractive outer surface to sporting goods such as golf clubs, hunting goods such as knives, outdoors equipment such as binocular outer casings, bow coatings, water canteens, field-compasses and the like. The articles according to the present invention can be stealth items such as for law enforcement and armed forces, such as helmets, buckles, ID tags, night vision equipment, laptop casings communications equipment, firearms and parts thereof such as sights, triggers, cartridges, barrels, and the like. Other articles within the scope of the present invention are jewelry, for example rings including rings wherein a stone may be set under tension and retained between two connected portions of the ring. Jewelry items can further comprise wedding bands, buckles, bracelets, chains, earrings, watches, chains, sunglass frames, cuff links, tie-pins, bracelets and necklaces. Yet further, marine items such as boat masts, deck handles, steering wheels, throttles; automotive parts such as gearshift levers, hubcaps, steering wheels; and household items such as door handles, cabinet handles, keys, cutlery, faucets, light fixtures and kitchen implements can all be provided within the scope of the present invention.

This invention has been described with respect to its preferred embodiments and contemplated utility. Variations can be made without undue experimentation by those skilled in the art with the expected results being obtained without departing from the spirit and scope of the invention described in the appended claims as interpreted in view of the applicable prior art.

What is claimed is:

1. A metallic article comprising:

a body having a hardened and abrasion resistant surface, the body made of a binary alloy consisting of zirconium and titanium, the binary alloy including between 18.4% to 65.6% of zirconium by atomic weight;

a protective darkened color oxide layer containing $ZrO_2$, the darkened color oxide layer is formed on the surface of the body by:

heating the body in an oxygen containing atmosphere supplied at a controlled flow rate at a heating temperature of between about 250 and about 880° C. and for a duration of between 10 to 110 minutes;

wherein the darkened color oxide layer is on a monochromatic color scale of dark grey to black;

wherein when the heating temperature is between about 480° C. and about 880° C. and the duration is between about 10 and about 70 minutes, the protective darkened color oxide layer has a black color; and wherein when the heating temperature is between about 250° C. and about 480° C. and the duration is between about 25 and about 70 minutes, the protective darkened color oxide layer has a grey color; and the metallic article having a polished satin or matte finish.

2. A metallic article comprising:

a body having a hardened and abrasion resistant surface, the body made of a binary alloy consisting of zirconium and titanium, the binary alloy including between 18.4% to 65.6% of zirconium by atomic weight;

a protective darkened color oxide layer containing $ZrO_2$, the darkened color oxide layer is formed on the surface of the body by:

heating the body in an oxygen containing atmosphere supplied at a controlled flow rate at a heating temperature between about 250 and about 880° C. and for a duration of between 10 to 110 minutes; and quenching the body in water following the heating step;

wherein the darkened color oxide layer is on a monochromatic color scale of dark grey to black;

wherein when the heating temperature is between about 480 and about 880° C. and the duration is between about 10 and about 70 minutes, the protective darkened color oxide layer has a black color;

wherein when the heating temperature is between about 250° C. and about 480° C. and the duration is between about 25 and about 70 minutes, the protective darkened color oxide layer has a grey color; and the metallic article having a polished satin or matte finish.

3. A metallic article comprising:

a body having a hardened and abrasion resistant surface, the body made of a binary alloy consisting of zirconium and titanium, the binary alloy including between 18.4% to 65.6% of zirconium by atomic weight;

a protective darkened color oxide layer containing $ZrO_2$, the darkened color oxide layer is formed on the surface of the body by:

heating the body in a first heating cycle;

heating the body in a second heating cycle;

wherein the first heating cycle is carried out at a temperature of between about 250 and about 480° C. for between for a duration of about 10 to about 40 minutes;

wherein the second heating cycle is carried out at a heating temperature of between about 480 and about 880° C. for between about 10 and about 70 minutes;

wherein the protective darkened color oxide layer is on a monochromatic color scale of dark grey to black.

4. A metallic article comprising:

a body having a hardened and abrasion resistant surface, the body made of a binary alloy consisting of zirconium and titanium, the binary alloy including between 18.4% to 65.6% of zirconium by atomic weight;

a protective darkened color oxide layer containing $ZrO_2$, the darkened color oxide layer is formed on the surface of the body by:

heating the body in a first heating cycle;

quenching the body in water following the first heating cycle;

heating the body in a second heating cycle;

wherein the first heating cycle is carried out at a temperature of between about 250 and about 480° C. for a duration of between about 10 to about 40 minutes;

wherein the second heating cycle is carried out at a heating temperature of between about 480 and about 880° C. and the duration is between about 10 and about 70 minutes;

wherein the protective darkened color oxide layer is on a monochromatic color scale of dark grey to black.

* * * * *